US007475723B2

(12) United States Patent
Ring et al.

(10) Patent No.: US 7,475,723 B2
(45) Date of Patent: Jan. 13, 2009

(54) APPARATUS AND METHODS FOR CREATION OF DOWN HOLE ANNULAR BARRIER

(75) Inventors: Lev Ring, Houston, TX (US); Robert Lance Cook, Katy, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 11/459,264

(22) Filed: Jul. 21, 2006

(65) Prior Publication Data

US 2007/0062694 A1 Mar. 22, 2007

Related U.S. Application Data

(60) Provisional application No. 60/701,720, filed on Jul. 22, 2005.

(51) Int. Cl.
*E21B 23/00* (2006.01)

(52) U.S. Cl. ..... 166/212; 166/250.08; 166/387

(58) Field of Classification Search ..... 166/206, 166/207, 212, 250.08, 380, 382, 387
See application file for complete search history.

(56) References Cited

U.S. PATENT DOCUMENTS

| | | | |
|---|---|---|---|
| 1,301,285 | A | 4/1919 | Leonard |
| 1,880,218 | A | 10/1932 | Simmons |
| 1,981,525 | A | 11/1934 | Price |
| 2,214,225 | A | 9/1940 | Drummond |
| 2,214,226 | A | 9/1940 | English |
| 2,519,116 | A | 8/1950 | Crake |
| 3,028,915 | A | 4/1962 | Jennings |
| 3,186,485 | A | 6/1965 | Owen |
| 3,203,483 | A | 8/1965 | Vincent |
| 3,245,471 | A | 4/1966 | Howard |
| 3,297,092 | A | 1/1967 | Jennings |
| 3,326,293 | A | 6/1967 | Skipper |
| 3,353,599 | A | 11/1967 | Swift |
| 3,354,955 | A | 11/1967 | Berry |
| 3,477,506 | A | 11/1969 | Malone |
| 3,489,220 | A | 1/1970 | Kinley |
| 3,498,376 | A | 3/1970 | Sizer et al. |

(Continued)

FOREIGN PATENT DOCUMENTS

| | | |
|---|---|---|
| RU | 1 367 586 | 11/1996 |

(Continued)

OTHER PUBLICATIONS

PCT Search Report, International Application No. PCT/US2006/028325, dated Nov. 21, 2006.

(Continued)

*Primary Examiner*—Jennifer H Gay
*Assistant Examiner*—Daniel P Stephenson
(74) *Attorney, Agent, or Firm*—Patterson & Sheridan, LLP

(57) ABSTRACT

Methods and apparatus are provided for performing an expedited shoe test using an expandable casing portion as an annular fluid barrier. Such an expandable annular fluid barrier may be used in conjunction with cement if so desired but cement is not required. Further provided are methods and apparatus for successfully recovering from a failed expansion so that a shoe test can be completed without replacement of the expandable casing portion.

12 Claims, 2 Drawing Sheets

U.S. PATENT DOCUMENTS

| | | | | |
|---|---|---|---|---|
| 3,669,190 | A | 6/1972 | Sizer et al. | |
| 3,691,624 | A | 9/1972 | Kinley | |
| 3,746,091 | A | 7/1973 | Owen et al. | |
| 3,776,307 | A | 12/1973 | Young | |
| 3,780,562 | A | 12/1973 | Kinley | |
| 3,785,193 | A | 1/1974 | Kinley et al. | |
| 4,069,573 | A | 1/1978 | Rogers, Jr. et al. | |
| 4,159,564 | A | 7/1979 | Cooper, Jr. | |
| 4,359,889 | A | 11/1982 | Kelly | |
| 4,414,739 | A | 11/1983 | Kelly | |
| 4,450,612 | A | 5/1984 | Kelly | |
| 4,502,308 | A | 3/1985 | Kelly | |
| 4,567,631 | A | 2/1986 | Kelly | |
| 4,976,322 | A | 12/1990 | Abdrakhmanov et al. | |
| 5,014,779 | A | 5/1991 | Meling et al. | |
| 5,031,699 | A | 7/1991 | Artynov et al. | |
| 5,052,483 | A | 10/1991 | Hudson | |
| 5,083,608 | A | 1/1992 | Abdrakhmanov et al. | |
| 5,322,127 | A | 6/1994 | McNair et al. | |
| 5,337,823 | A | 8/1994 | Nobileau | |
| 5,348,095 | A | 9/1994 | Worrall et al. | |
| 5,388,648 | A | 2/1995 | Jordan, Jr. | |
| 5,667,011 | A | 9/1997 | Gill et al. | |
| 5,685,369 | A | 11/1997 | Ellis et al. | |
| 5,785,120 | A | 7/1998 | Smalley et al. | |
| 5,787,984 | A | 8/1998 | Mabile | |
| 5,794,702 | A * | 8/1998 | Nobileau | 166/380 |
| 5,979,560 | A | 11/1999 | Nobileau | |
| 6,070,671 | A | 6/2000 | Cumming et al. | |
| 6,073,692 | A | 6/2000 | Wood et al. | |
| 6,085,838 | A | 7/2000 | Vercaemer et al. | |
| 6,098,717 | A | 8/2000 | Bailey et al. | |
| 6,135,208 | A | 10/2000 | Gano et al. | |
| 6,253,852 | B1 | 7/2001 | Nobileau | |
| 6,328,113 | B1 | 12/2001 | Cook | |
| 6,354,373 | B1 | 3/2002 | Vercaemer et al. | |
| 6,425,444 | B1 | 7/2002 | Metcalfe et al. | |
| 6,431,282 | B1 * | 8/2002 | Bosma et al. | 166/288 |
| 6,446,724 | B2 | 9/2002 | Baugh et al. | |
| 6,457,532 | B1 | 10/2002 | Simpson | |
| 6,470,966 | B2 | 10/2002 | Cook et al. | |
| 6,513,588 | B1 | 2/2003 | Metcalfe | |
| 6,543,552 | B1 | 4/2003 | Metcalfe et al. | |
| 6,571,871 | B2 | 6/2003 | Lauritzen et al. | |
| 6,578,630 | B2 | 6/2003 | Simpson et al. | |
| 6,708,767 | B2 | 3/2004 | Harrall et al. | |
| 6,712,151 | B2 | 3/2004 | Simpson et al. | |
| 6,722,451 | B2 * | 4/2004 | Saugier | 175/57 |
| 6,725,934 | B2 * | 4/2004 | Coronado et al. | 166/313 |
| 6,742,598 | B2 | 6/2004 | Whitelaw et al. | |
| 6,854,522 | B2 * | 2/2005 | Brezinski et al. | 166/387 |
| 6,868,905 | B2 | 3/2005 | Lauritzen et al. | |
| 6,907,937 | B2 * | 6/2005 | Whanger et al. | 166/387 |
| 6,976,536 | B2 | 12/2005 | Simpson et al. | |
| 7,017,670 | B2 | 3/2006 | Hazel et al. | |
| 7,028,780 | B2 | 4/2006 | Maguire | |
| 7,063,149 | B2 | 6/2006 | Simpson et al. | |
| 7,086,480 | B2 | 8/2006 | Simpson et al. | |
| 7,090,024 | B2 | 8/2006 | Simpson et al. | |
| 7,090,025 | B2 | 8/2006 | Haugen et al. | |
| 7,104,322 | B2 | 9/2006 | Whanger et al. | |
| 7,121,351 | B2 | 10/2006 | Luke et al. | |
| 7,124,829 | B2 * | 10/2006 | Braddick | 166/382 |
| 7,152,679 | B2 | 12/2006 | Simpson | |
| 7,204,306 | B2 | 4/2007 | Abdrakhmanov et al. | |
| 7,350,584 | B2 | 4/2008 | Simpson et al. | |
| 7,350,585 | B2 | 4/2008 | Simpson et al. | |
| 2003/0037931 | A1 | 2/2003 | Coon | |
| 2003/0205386 | A1 | 11/2003 | Johnston et al. | |
| 2004/0045616 | A1 * | 3/2004 | Cook et al. | 138/98 |
| 2004/0079528 | A1 | 4/2004 | Metcalfe et al. | |
| 2004/0140103 | A1 | 7/2004 | Steele et al. | |
| 2004/0159446 | A1 | 8/2004 | Haugen et al. | |
| 2004/0173360 | A1 | 9/2004 | Harrall et al. | |
| 2005/0217865 | A1 | 10/2005 | Ring | |
| 2005/0269107 | A1 | 12/2005 | Cook et al. | |
| 2006/0076147 | A1 | 4/2006 | Ring | |

FOREIGN PATENT DOCUMENTS

| | | |
|---|---|---|
| RU | 2 079 633 | 5/1997 |
| RU | 2 083 798 C1 | 7/1997 |
| SU | 123963 | 11/1984 |
| SU | 1813171 | 7/1991 |
| SU | 1239363 | 11/1994 |
| WO | WO 95/03476 | 2/1995 |
| WO | WO 98/00626 | 1/1998 |
| WO | WO 99/35368 | 7/1999 |
| WO | WO 00/61914 | 10/2000 |

OTHER PUBLICATIONS

Canadian Office Action, Application No. 2,666,563, dated Sep. 10, 2007.

* cited by examiner

APPARATUS AND METHODS FOR CREATION OF DOWN HOLE ANNULAR BARRIER

CROSS-REFERENCE TO RELATED APPLICATION

This application claims benefit of U.S. Provisional Patent Application Ser. No. 60/701,720, filed on Jul. 22, 2005, which application is incorporated herein by reference in its entirety.

BACKGROUND OF THE INVENTION

1. Field of the Invention

Embodiments of the invention generally relate to methods and apparatus for creating an annular barrier in a well bore. More particularly, the invention relates to methods and apparatus for isolating at least a portion of a well bore from at least another portion of the well bore.

2. Description of the Related Art

As part of the well bore construction process, a hole or well bore is typically drilled into the earth and then lined with a casing or liner. Sections of casing or liner are threaded together or otherwise connected as they are run into the well bore to form what is referred to as a "string." Such casing typically comprises a steel tubular good or "pipe" having an outer diameter that is smaller than the inner diameter of the well bore. Because of the differences in those diameters, an annular area occurs between the inner diameter of the well bore and the outer diameter of the casing and absent anything else, well bore fluids and earth formation fluids are free to migrate lengthwise along the well bore in that annular area.

Wells are typically constructed in stages. Initially a hole is drilled in the earth to a depth at which earth cave-in or well bore fluid control become potential issues. At that point drilling is stopped and casing is placed in the well bore. While the casing may structurally prevent cave-in, it will not prevent fluid migration along a length of the well in the annulus between the casing and the well bore. For that reason the casing is typically cemented in place. To accomplish that, a cement slurry is pumped down through the casing and out the bottom of the casing string. Drilling fluid, water, or other suitable fluid is then used to displace the cement slurry into the annulus. Typically, drillable wiper plugs are used to separate the cement from the well fluid in advance of the cement volume and behind it. The cement is left to cure in the annulus thereby forming a barrier to fluid migration within the annulus. After the cement has cured, the cured cement remaining in the interior of the casing string is drilled out and the cement seal or barrier between the casing and the formation is pressure tested. A drill bit is then run through the cemented casing and drilling is commenced from the bottom of that casing. A new length of hole is then drilled, cased and cemented. Depending on the total length of well several stages may be drilled and cased as described.

As previously mentioned, the cement barrier is tested between each construction stage to ensure that a fluid tight annular seal has been achieved. Typically the barrier test is performed by applying pressure to the casing internally. That is achieved by pumping fluid into the casing string from the surface. The pressure exits the bottom of the casing and bears on the annular cement barrier. The pressure is then monitored at the surface for leakage. Such testing is often referred to as a "shoe test" where the word "shoe" indicates the lowermost portion or bottom of a given casing string. When another well section is needed below a previously cased section, it is important that a successful shoe test be completed before progressing with the drilling operation.

Unfortunately cementing operations require cessation of drilling operations for considerable periods of time. It takes time to mix and pump the cement. It takes more time to allow the cement to cure once it is in place. During the cementing operations drilling rig costs and other fixed costs still accrue yet no drilling progress is made. Well construction is typically measured in feet per day and because fixed costs such as the drilling rig are charged on a per day basis that translates to dollars per foot. Because cementing takes time with zero feet drilled during the cementing operations those operations merely increases the dollar per foot metric. It is beneficial to minimize or eliminate such steps in order to decrease the average dollar per foot calculation associated with well construction costs.

Expandable well bore pipe has been used for a variety of well construction purposes. Such expandable pipe is typically expanded mechanically by means of some type of swage or roller device. An example of expandable casing is shown in U.S. Pat. No. 5,348,095 and that patent is incorporated by reference herein in its entirety. Such expandable casing has been described in some embodiments as providing an annular fluid barrier when incorporated as part of a casing string.

Expandable pipe has also been shown having non-circular ("folded") pre-expanded cross-sections. Such initially non-circular pipe is shown to assume a substantially circular cross-section upon expansion. Such pipe having substantially the same cross-sectional perimeter before and after expansion has been shown (i.e. where the expansion comprises a mere "unfolding" of the cross-section). Other such pipe has been shown wherein the cross-section is "unfolded" and its perimeter increased during the expansion process. Such non-circular pipes can be expanded mechanically or by application of internal pressure or by a combination of the two. An example of "folded" expandable pipe is shown in U.S. Pat. No. 5,083,608 and that patent is incorporated by reference herein in its entirety.

As mentioned above, mechanical pipe expansion mechanisms include swage devices and roller devices. An example of a swage type expander device is shown in U.S. Pat. No. 5,348,095 and that patent is incorporated by reference herein in its entirety. An example of a roller type expander device is shown in U.S. Pat. No. 6,457,532 and that patent is incorporated by reference herein in its entirety. U.S. Pat. No. 6,457,532 also shows a roller type expander having compliant characteristics that allow it to "form fit" an expandable pipe to an irregular surrounding surface such as that formed by a well bore. Such form fitting ensures better sealing characteristics between the outer surface of the pipe and the surrounding surface.

Expandable pipe has been shown and described having various exterior coatings or elements thereon to augment any annular fluid barrier created by the pipe. Elastomeric elements have been described for performing such function. Coated expandable pipe is shown in U.S. Pat. No. 6,789,622 and that patent is incorporated by reference herein in its entirety.

Regardless of whether or not the cross-section is initially circular or is folded, expandable pipe has limitations of expandability based on the expansion mechanism chosen. When expandable pipe is deployed for the purpose of creating an annular fluid barrier the initial configuration of the pipe and the expansion mechanism used must be carefully tailored to a given application to ensure that the expansion is sufficient to create a barrier. If the chosen expansion mechanism is miscalculated in a given circumstance the result can be extremely disadvantageous. In that situation the expanded pipe is not useful as a barrier and further, because the pipe has been expanded retrieval may be impractical. Remedying such a situation consumes valuable rig time and accrues other costs associated with remediation equipment and replacement of the failed expandable pipe.

Therefore, a need exists for improved methods and apparatus for creating an annular barrier proximate a casing shoe that eliminates the necessity for cementing. There further exists a need for improved methods and apparatus for creating an annular fluid barrier using expandable pipe that provides for a successful recovery from a failed expansion attempt.

SUMMARY OF THE INVENTION

The invention generally relates to methods and apparatus for performing an expedited shoe test using an expandable casing portion as an annular fluid barrier. Such an expandable annular fluid barrier may be used in conjunction with cement if so desired but cement is not required. Further provided are methods and apparatus for successfully recovering from a failed expansion so that a shoe test can be completed without replacement of the expandable casing portion.

In one embodiment a casing or liner string is lowered into a well bore, wherein the casing or liner string includes a non-circular or "folded" expandable portion proximate a lower end of the string. The expandable portion includes at least a section having a coating of elastomeric material about a perimeter thereof. The lowermost portion of the string includes a ball seat. While the string is being lowered fluid can freely enter the string through the ball seat to fill the string. When the string reaches the desired location in the well bore, a ball is dropped from the surface of the earth into the interior of the string. The ball subsequently locates in the ball seat. When located in the ball seat, the ball seals the interior of the string so that fluid cannot exit therefrom. Pressure is applied, using fluid pumps at the surface, to the interior of the string thereby exerting internal pressure on the folded expandable portion. At a predetermined pressure the folded expandable portion unfolds into a substantially circular cross-section having a diameter larger than the major cross-sectional axis of the previously folded configuration. Such "inflation" of the folded section presses the elastomeric coating into circumferential contact with the well bore there around thereby creating an annular seal between the string and the well bore. The ball is now retrieved from the ball seat and withdrawn from the interior of the string by suitable means such as a wireline conveyed retrieval tool. Alternatively, pressure may be increased inside the string until the ball plastically deforms the ball seat and is expelled from the lower end of the string. Pressure is then applied to the interior of the string and held for a period of time while monitoring annular fluid returns at the surface. If such pressure holds then the cementless shoe test has been successful.

If the above described shoe test pressure doesn't hold and fluid returns are evident from the annulus then a recovery phase is required. A rotary expansion tool is lowered on a work pipe string through the interior of the casing string until the rotary expansion tool is located proximate the unfolded section of expandable casing. The rotary expansion tool is activated by fluid pressure applied to the interior of the work string. The work string is then rotated and translated axially along the unfolded section of expandable casing thereby expanding that unfolded section into more intimate contact with the well bore there around. Following that secondary expansion the work string and expansion tool are withdrawn from the casing. A second shoe test may now be performed as previously described.

Optionally, cement may be used in conjunction with the expandable casing portion to add redundancy to the fluid barrier seal mechanism. In such an embodiment a casing or liner string is lowered into a well bore, wherein the casing or liner string includes a non-circular or "folded" expandable portion proximate a lower end of the string. The expandable portion includes at least a section having a coating of elastomeric material about a perimeter thereof. The lowermost portion of the string includes a ball seat. While the string is being lowered fluid can freely enter the string through the ball seat to fill the string. When the string reaches the desired location in the well bore a volume of cement sufficient to fill at least a portion of the annulus between the casing and the well bore, is pumped through the interior of the casing, out the lower end and into the annulus adjacent the lower end including the expandable portion. A ball is then dropped from the surface of the earth into the interior of the string. The ball subsequently locates in the ball seat. When located in the ball seat, the ball seals the interior of the string so that fluid cannot exit there from. Pressure is applied, using fluid pumps at the surface, to the interior of the string thereby exerting internal pressure on the folded expandable portion. At a predetermined pressure the folded expandable unfolds into a substantially circular cross-section having a diameter larger than the major cross-sectional axis of the previously folded configuration. Such "inflation" of the folded section presses the elastomeric coating into circumferential contact with the cement and well bore there around thereby creating an annular seal between the string and the well bore. The ball is now retrieved from the ball seat and withdrawn from the interior of the string by suitable means such as a wireline conveyed retrieval tool. Alternatively, pressure may be increased inside the string until the ball plastically deforms the ball seat and is expelled from the lower end of the string. Pressure can now be applied to the interior of the string and held for a period of time while monitoring annular fluid returns at the surface. If such pressure holds then the cement enhanced shoe test has been successful.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of the invention and are therefore not to be considered limiting of its scope, for the invention may admit to other equally effective embodiments.

DETAILED DESCRIPTION OF THE PREFERRED EMBODIMENT

The invention generally relates to methods and apparatus for creating an annular barrier about a casing shoe.

Figure 1:
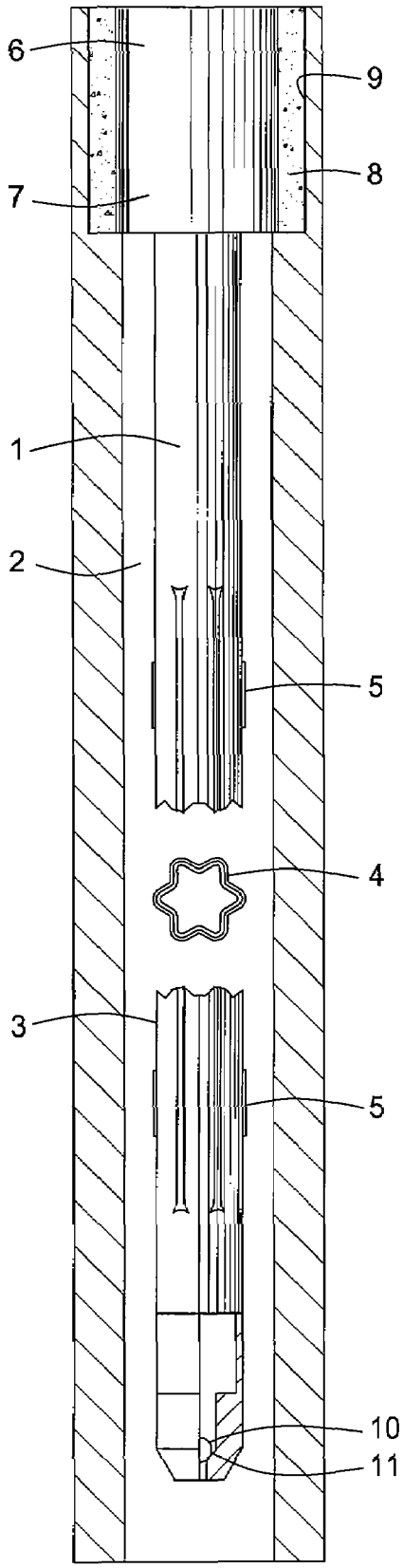
FIG. 1 shows a casing string in a sectioned well bore where the casing string includes an unexpanded folded expandable portion and a cross-section thereof and having two elastomeric coated regions about a perimeter of the folded portion.
Figure 2:
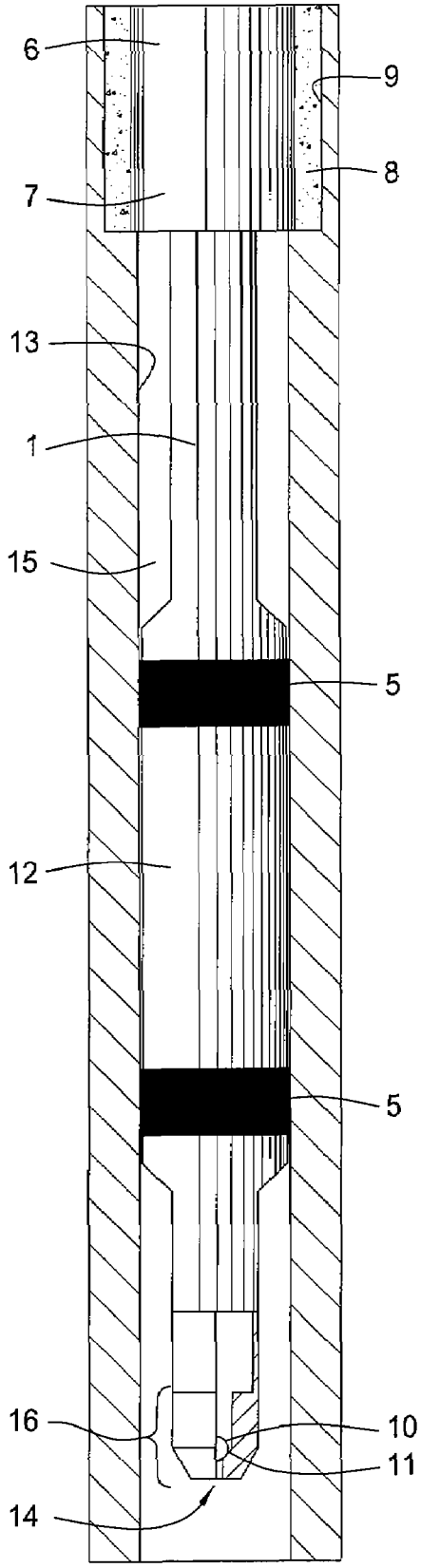
FIG. 2 shows a casing string in a sectioned well bore where the casing string includes an expanded expandable portion having two elastomeric coating regions in contact with the well bore.
Figure 3:
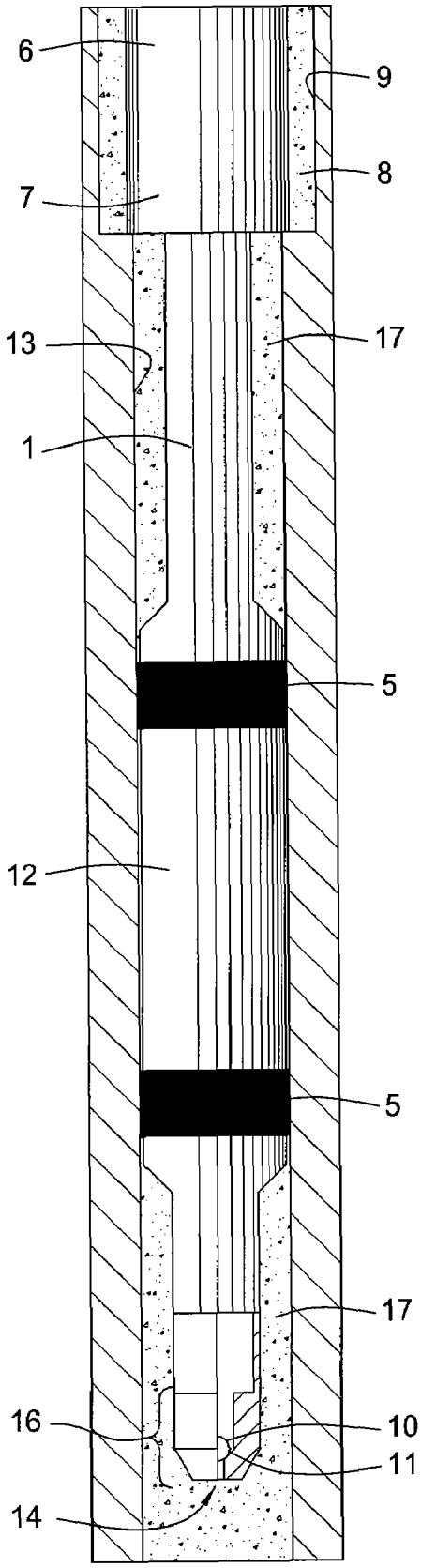
FIG. 3 shows a casing string in a sectioned well bore where the casing string includes an expanded expandable portion having two elastomeric coating regions in contact with cement and the well bore.

The embodiments of FIGS. 1, 2 and 3 are shown deployed beneath a previously and conventionally installed casing 6 in a previously drilled well bore 9. The annular barrier between the conventional shoe portion 7 of the previously installed casing 6 and the previously drilled well bore 9 is only cement 8.

FIG. 1 shows a casing string 1 deployed in a sectioned well bore 2 where the casing string 1 includes an unexpanded folded expandable portion 3 and a cross-section thereof 4 and having two elastomeric coated regions 5 about a perimeter of the folded portion 3. The well bore 2 is drilled following the drilling of the well bore 9, running of the casing 6, placing of the cement 8 and shoe testing the barrier formed by the cement 8. The casing string 1 is lowered from the surface into the well bore 2 and a ball 10 is placed in the interior of the casing 1 and allowed to seat in a ball seat 11 thereby plugging the lower end of the casing string 1.

A predetermined pressure is applied to the interior of the casing 1 thereby unfolding the expandable portion 3. As shown in FIG. 2 the unexpanded folded expandable portion 3 becomes an expanded portion and an annular barrier 12 in response to the predetermined pressure. The expanded portion 12 thereby pushes radially outward toward a well bore wall 13 and correspondingly presses the elastomeric coated regions 5 into sealing engagement with the well bore wall 13. Optionally, the coated regions 5 may comprise any suitable compressible coating such as soft metal, Teflon, elastomer, or combinations thereof. Alternatively, the expanded portion 12 may be used without the coated regions 5. The ball 10 is now removed from the ball seat 11 so that fluid path 14 is unobstructed. Pressure is applied to the interior of the casing string 1 and well bore annulus 15 is monitored for pressure change. If no pressure change is observed in the well bore annulus 15 then the annular barrier 12 has been successfully deployed. Upon determination of such successful deployment, the shoe portion 16 is drilled through and drilling of a subsequent stage of the well may progress.

FIG. 3 shows a deployed annular barrier 12 surrounded by cement 17. In the embodiment of FIG. 3 deployment of the annular barrier 12 progresses as described above in reference to FIGS. 1 and 2 with a couple of notable exceptions. Before seating of the ball 10 in the ball seat 11 and before the application of the predetermined pressure (for expanding the unexpanded folded expandable portion) a volume of cement slurry is pumped as a slug down through the interior of the casing 1, out through the fluid path 14 and up into the well bore annulus 15. The cement slurry slug may be preceded and/or followed by wiper plugs (not shown) having suitable internal diameters (for passing the ball 10) initially obstructed by properly calibrated rupture disks. The ball 10 is then located in the ball seat 11 and the predetermined expanding pressure is applied to the interior of the casing 1. The ball 10 is now removed from the ball seat 11 so that fluid path 14 is unobstructed. Pressure is applied to the interior of the casing string 1 and the well bore annulus 15 is monitored for pressure change. If no pressure change is observed in the well bore annulus 15 then the annular barrier 12 has been successfully deployed. If a pressure increase is observed in the well bore annulus 15 then the cement is given a proper time to cure and the pressure is reapplied to the interior of the casing 1. Upon determination that there is no corresponding pressure change in the well bore annulus 15, the shoe portion 16 is drilled through and drilling of a subsequent stage of the well may progress.

Figure 4:
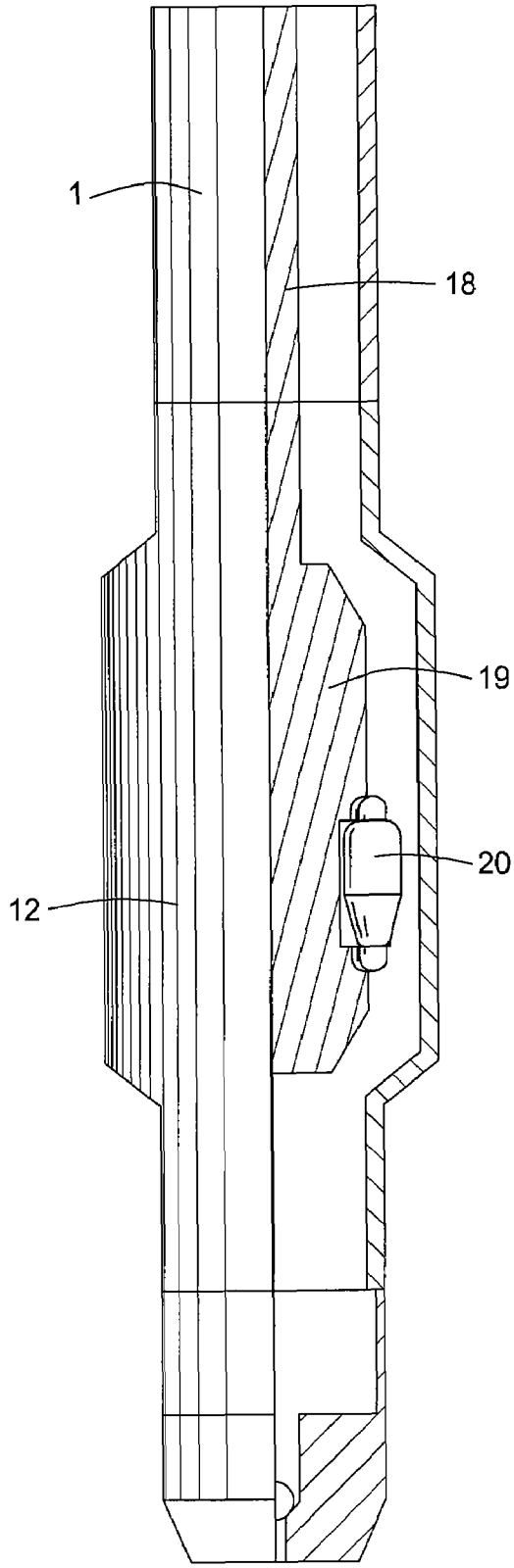
FIG. 4 shows a casing string in half section including an expanded expandable portion having a rotary expansion tool disposed therein.

FIG. 4 shows a rotary expansion tool 19 suspended on a work string 18 and having at least one radially extendable expansion member 20. The work string 18 with the rotary expansion tool 19 connected thereto are lowered through the casing 1 until the expansion member 20 is adjacent an expanded portion 12 of the casing string 1. The embodiment shown in FIG. 4 may be optionally used in the processes described above regarding FIGS. 1, 2 and 3.

Referring to FIGS. 2 and 3, a predetermined pressure is applied to the interior of the casing 1 thereby unfolding the expandable portion 3. As shown in FIG. 2 the unexpanded folded expandable portion 3 becomes an expanded portion and an annular barrier 12 in response to the predetermined pressure. The expanded portion 12 thereby pushes radially outward toward a well bore wall 13 and correspondingly presses the elastomeric coated regions 5 into sealing engagement with the well bore wall 13. Optionally, the coated regions 5 may comprise any suitable compressible coating such as soft metal, Teflon, elastomer, or combinations thereof. Alternatively, the expanded portion 12 may be used without the coated regions 5. The ball 10 is now removed from the ball seat 11 so that fluid path 14 is unobstructed. Pressure is applied to the interior of the casing string 1 and well bore annulus 15 is monitored for pressure change. If no pressure change is observed in the well bore annulus 15 then the annular barrier 12 has been successfully deployed. If a pressure increase is observed in the well bore annulus 15 then referring to FIG. 4, the rotary expansion tool 19 is lowered on the work string 18 through the casing 1 until the expansion member 20 is adjacent an interior of the expanded portion 12. An expansion tool activation pressure is applied to the interior of the work string 18 thereby radially extending the at least one expansion member 20 into compressive contact with the interior of the expanded portion 12. The work string 18 is simultaneously rotated and axially translated along at least a portion of the interior of the expanded portion 12 thereby further expanding the portion of the expanded portion into more intimate contact with the well bore wall 13. Following the rotary expansion of the expanded portion 12 the work string 18 and expansion tool 19 are withdrawn from the well. Pressure is now reapplied to the interior of casing 1 and pressure is monitored in annulus 15. If no pressure change is observed in annulus 15 then the shoe portion 16 is drilled through and drilling of a subsequent stage of the well may progress. Optionally, the previously described step of placing cement in annulus 15 may be used in combination with the step of pressurized unfolding and the step of rotary expansion as described herein.

While the foregoing is directed to embodiments of the present invention, other and further embodiments of the invention may be devised without departing from the basic scope thereof, and the scope thereof is determined by the claims that follow.

We claim:

1. A method for creating and testing an annular barrier, comprising:

drilling a well bore;

lowering a tubular into the well bore, the tubular including a folded expandable portion proximate a lower end thereof;

using fluid pressure to expand the expandable portion into a substantially sealing engagement with the well bore;

applying a pressure to a first side of the sealing engagement between expandable portion and the well bore;

monitoring a second side of the sealing engagement for a change in pressure; and mechanically expanding the expandable portion when a change in pressure is detected.

2. The method of claim 1, further comprising providing at least one sealing member on the expandable portion of the tubular.

3. The method of claim 2, wherein the at least one sealing member is expanded into contact with the well bore.

4. The method of claim 1, further comprising closing off fluid communication through the tubular, thereby increasing the fluid pressure in the tubular.

5. The method of claim 4, further comprising dropping a ball to close off fluid communication.

6. The method of claim 5, further comprising retrieving the ball prior to applying the pressure to the first side of the sealing engagement.

7. The method of claim 5, further comprising increasing pressure to expel the ball from the tubular.

8. The method of claim 1, further comprising using a rotary expander to mechanically expand the expandable portion.

9. The method of claim 8, further comprising applying a second pressure to the first side of the sealing engagement between expandable portion and the well bore and monitoring the second side of the sealing engagement for a change in pressure.

10. The method of claim 1, wherein the tubular comprises casing.

11. The method of claim 1, further comprising supplying cement into an annulus between the tubular and the well bore prior to applying fluid pressure.

12. The method of claim 11, wherein the expandable portion is expanded by fluid pressure against the cement.

* * * * *